US009743720B2

(12) United States Patent
Zur et al.

(10) Patent No.: US 9,743,720 B2
(45) Date of Patent: Aug. 29, 2017

(54) FASTENER WITH TWO FASTENING MECHANISMS

(71) Applicant: ANGEL SENSE LTD, Yehud (IL)

(72) Inventors: Eyal Benjamin Zur, Tel Aviv (IL); Nery Ben Azar, Yehud (IL)

(73) Assignee: ANGEL SENSE LTD., Yehud (IL)

( * ) Notice: Subject to any disclaimer, the term of this patent is extended or adjusted under 35 U.S.C. 154(b) by 0 days.

(21) Appl. No.: 15/114,283

(22) PCT Filed: Jan. 27, 2015

(86) PCT No.: PCT/IL2015/050093
§ 371 (c)(1),
(2) Date: Jul. 26, 2016

(87) PCT Pub. No.: WO2015/111064
PCT Pub. Date: Jul. 30, 2015

(65) Prior Publication Data

US 2017/0006974 A1 Jan. 12, 2017

Related U.S. Application Data

(60) Provisional application No. 61/931,797, filed on Jan. 27, 2014.

(51) Int. Cl.
*G08B 13/24* (2006.01)
*A44B 17/00* (2006.01)
(Continued)

(52) U.S. Cl.
CPC ..... *A44B 17/0047* (2013.01); *A41F 1/002* (2013.01); *A44B 17/007* (2013.01);
(Continued)

(58) Field of Classification Search
CPC ..... A44B 17/0047; A44B 17/007; A44B 17/0076; A41F 1/002; G08B 13/2434
(Continued)

(56) References Cited

U.S. PATENT DOCUMENTS 7,535,356 B2 5/2009 Lerch et al.
8,521,448 B1 * 8/2013 Ung ..... B64F 5/0045 702/42
(Continued)

FOREIGN PATENT DOCUMENTS

DE 202005001787 U1 5/2005
EP 1947973 B1 4/2014
(Continued)

*Primary Examiner* — Omer S Khan
(74) *Attorney, Agent, or Firm* — Browdy and Neimark, PLLC

(57) ABSTRACT

A fastener for fastening a first element to a second element comprising: a first part; a second part fastenable to the first part via a first fastening mechanism; and a third part fastenable to the second part via a second fastening mechanism. The third part comprises at least one protruding member for inserting thereof to the second element for fastening the second element between the second and third parts. The first fastening mechanism is configured such that to open the fastening of the first part to the second part an external tool such as a key or a magnet should be applied.

8 Claims, 6 Drawing Sheets

(51) Int. Cl.

| | |
|---|---|
| ***E05B 73/00*** | (2006.01) |
| ***A41F 1/00*** | (2006.01) |
| *E05B 63/00* | (2006.01) |

(52) U.S. Cl.
CPC ..... *A44B 17/0076* (2013.01); *E05B 73/0017* (2013.01); *G08B 13/2434* (2013.01); *E05B 2063/0026* (2013.01)

(58) Field of Classification Search
USPC ..... 340/572.6
See application file for complete search history.

(56) References Cited

U.S. PATENT DOCUMENTS

| | | | | |
|---|---|---|---|---|
| 2003/0145441 | A1 | 8/2003 | Andersson et al. | |
| 2004/0092874 | A1 | 5/2004 | Mazidji et al. | |
| 2005/0186027 | A1 | 8/2005 | Kang | |
| 2006/0243006 | A1* | 11/2006 | Christensen ..... | A44B 11/266 70/58 |
| 2007/0120686 | A1 | 5/2007 | Spagna | |
| 2013/0298360 | A1* | 11/2013 | Richardson ..... | F16B 21/073 24/634 |

FOREIGN PATENT DOCUMENTS

| | | | |
|---|---|---|---|
| WO | 02060293 | A1 | 8/2002 |
| WO | 2011118412 | A1 | 9/2011 |
| WO | 2013086562 | A1 | 6/2013 |

* cited by examiner

FASTENER WITH TWO FASTENING MECHANISMS

CROSS-REFERENCE TO RELATED PATENT APPLICATIONS

This application claims priority from U.S. provisional patent application No. 61/931,797 filed on Jan. 27, 2014, which is incorporated herein by reference in its entirety.

FIELD OF THE INVENTION

The present invention generally relates to fasteners for fastening at least two elements having two fastening mechanism.

BACKGROUND OF THE INVENTION

Fasteners such as snap fasteners, buckles and snap fasteners are commonly used for fastening elements to one another. Snap fasteners are often used for preventing theft of items from shops and typically include a set of spherical elements removably snapping a metallic elongated protrusion of the fastener such that the snap holding can only be released by using a powerful magnet externally from the fastener to pull out the metallic protrusion attracted to the magnet. These fasteners are typically equipped with RFID (radio frequency ID) tags to have a detector detect them to prevent shoplifting for instance, when used for attaching to articles in a shop.

US patent application publication No. 2005186027 teaches a fastener having a key to fasten two separate articles for backpacks or bags carrying personal belongings or valuables or the like, and the fastener includes the fastener includes at least two locking pins installed in the receiving unit and resiliently supported by a biasing member, a key receiving groove formed on a front surface of the receiving unit in a desired depth and having an optional shape, a plurality of locking holes, formed in the inserting unit at a position corresponding to the locking pin, for receiving the locking pin, so that the inserting unit is snapped to the receiving unit, and a key adapted to complementarily match with the key receiving groove formed on the front surface of the receiving unit, and having a permanent magnet displaced at a position corresponding to the locking pin to pull the locking pin from the locking hole. When the inserting unit is inserted into the receiving unit, the locking pin installed in the receiving unit and biased therein by a biasing member is snapped to the locking hole of the inserting unit. A fastening state of the inserting unit is released by inserting the key into the key receiving groove formed on the front surface of the receiving unit.

US patent application publication No. 2003145441 teaches a fastening mechanism comprising a pin having a shank coupled to the head at a first end of said shank. A metallic pin-lock is provided having a base portion coupled to a resilient pin-engaging portion. The shank has a circumferentially-formed notch at a second end, said notch being adapted to receive the resilient pin-engaging portion. A resilient member is coupled to the base portion of the metallic pin-lock and to a mobile phone housing. A retainer is provided for housing said fastening mechanism inside the mobile phone housing. Upon insertion of the pin into the pin-lock, the pin is adapted to move the resilient pin-engaging portion a predetermined distance until the resilient pin-engaging portion engages the circumferentially-formed notch. The pin-lock is adapted to be removed from the pin via a magnet attracting at least a portion of the pin-lock away from the pin.

Other references such as WO2013086562, EP1947973, U.S. Pat. No. 7,535,356, US2007120686, WO02060293, DE202005001787 and US2004092874 also disclose various types of magnet or buckle type fasteners.

SUMMARY OF THE INVENTION

According to some aspects of the invention, there is provided a fastener for fastening a first element to a second element, wherein the fastener comprises: (a) a first part; (b) a second part fastenable to the first part via a first fastening mechanism; and (c) a third part fastenable to the second part via a second fastening mechanism, wherein the third part comprises at least one protruding member for inserting thereof to the second element for fastening the second element between the second and third parts, wherein the first part is attachable, embedded or placed in the first element thereby ultimately enabling fastening the first element to the second element, and wherein the first fastening mechanism is configured such that to open the fastening of the first part to the second part an external tool should be applied. For example, a powerful magnetic element or key has to be used for unfastening the first and second parts thereby releasing the fastening of the first and second elements.

In some embodiments, the first fastening mechanism is different in principle than the second fastening mechanism. In other embodiments, the same fastening mechanisms are used. For example both fastening mechanisms may be based on snap and/or magnetic mechanisms.

According to some embodiments, the first fastening mechanism is based on snap and/magnetic fastening and the second fastening mechanism is based on snap fastening.

According to some embodiments, the first part comprises: a casing configured to form at least one inner groove, a recess and at least one projection for snap fastening the at least one projection located inwardly over the recess, the recess is configured to hold therein at least one portion of the second part for fastening thereto; at least one metallic piece located inside the at least one inner groove; and at least one spring engaging the at least one metallic piece such that once applying an external magnetic force, using an external magnet, the at least one metallic piece moves in the groove such that it compresses the at least one spring engaging thereof thereby slightly dilating the recess to allow removal of the second part therefrom.

Optionally, the second part comprises a knob shaped head portion connected to an elongated portion having a recess therein; and the third part comprises a flattened part connected to a protruding part, wherein the protruding part is configured to be inserted into the recess of the elongated part of the second part for fastening thereto and the knob shaped head portion of the second part is configured for fitting into the recess of the first part for fastening thereto.

Optionally, the protruding part of the third part is externally serrated and the recess of the second part is inwardly serrated to allow irremovable fastening of the third part to the second part.

Alternatively, the protruding part of the third part is externally screw threaded and the recess of the second part is inwardly screw threaded to allow removable fastening of the third part to the second part.

According to some embodiments, the third part comprises an elongated pin like part connected to a flattened part, and the second part comprises: a head configured to fit into the recess of the first part; an elongated portion having a recess therein configured for receiving the pin like part of the third part; and at least one spherical element configured for snap fastening the pin like part of the third part in the recess of the second part.

According to other embodiments, the first part comprises: a casing having an opening recess for fitting therethrough a portion of the second part and at least one key hole; and a clip member located inside the casing and configured for clip fastening the portion of the second member once inserted through the opening recess, wherein the clip member has two pincers connected to a grip. In these embodiments, once a designated key configured to fit into the at least one key hole is inserted through the at least one key hole and rotated therein, it dilates the gap between the pincers thereby allowing removal of the second part portion from the opening recess for unfastening thereof.

Optionally, the at least one key hole comprises a single key hole.

The designated key optionally includes protrusions and the single key hole is located such that the protrusions of the key will be located between the princes of the clip member for dilating thereof upon rotation of this key.

Alternatively, the at least one key hole comprises two key holes located in front of the pincers and the designated key includes two edges configured for being inserted through those key holes for dilating the gap between said pincers.

According to some embodiments, the first element to or in which the first part of the fastener, in any embodiment thereof, is attached, embedded or placed comprises a tracking unit, configured to enable tracking that second element to which the fastener fastens or for tracking the person which carries it. The tracking unit may comprise a transmission unit configured for transmitting signals for locating the second element to which the first element ultimately fastens through the fastener, such as, for example, RFID device, GPS device or any other transmission device that allows wireless long and/or short distance locating and thereby tracking.

BRIEF DESCRIPTION OF THE DRAWINGS

FIG. 1A shows the fastener in an open unfastened position; FIG. 1B shows the fastener in a closed fastened position; and FIG. 1C shows the fastener in a closed position having a magnet used for allowing unfastening of the fastener.

FIG. 4A shows a perspective view of the fastener with the lock mechanism; FIG. 4B shows a perspective transparent view of a first part of the fastener; FIG. 4C shows a perspective exploded view of the first part of the fastener.

FIG. 5A shows a perspective view of the fastener; FIG. 5B shows a perspective transparent view of a first part of the fastener; FIG. 5C shows a perspective exploded view of the first part of the fastener.

DETAILED DESCRIPTION OF SOME EMBODIMENTS OF THE INVENTION

Figure 1A:
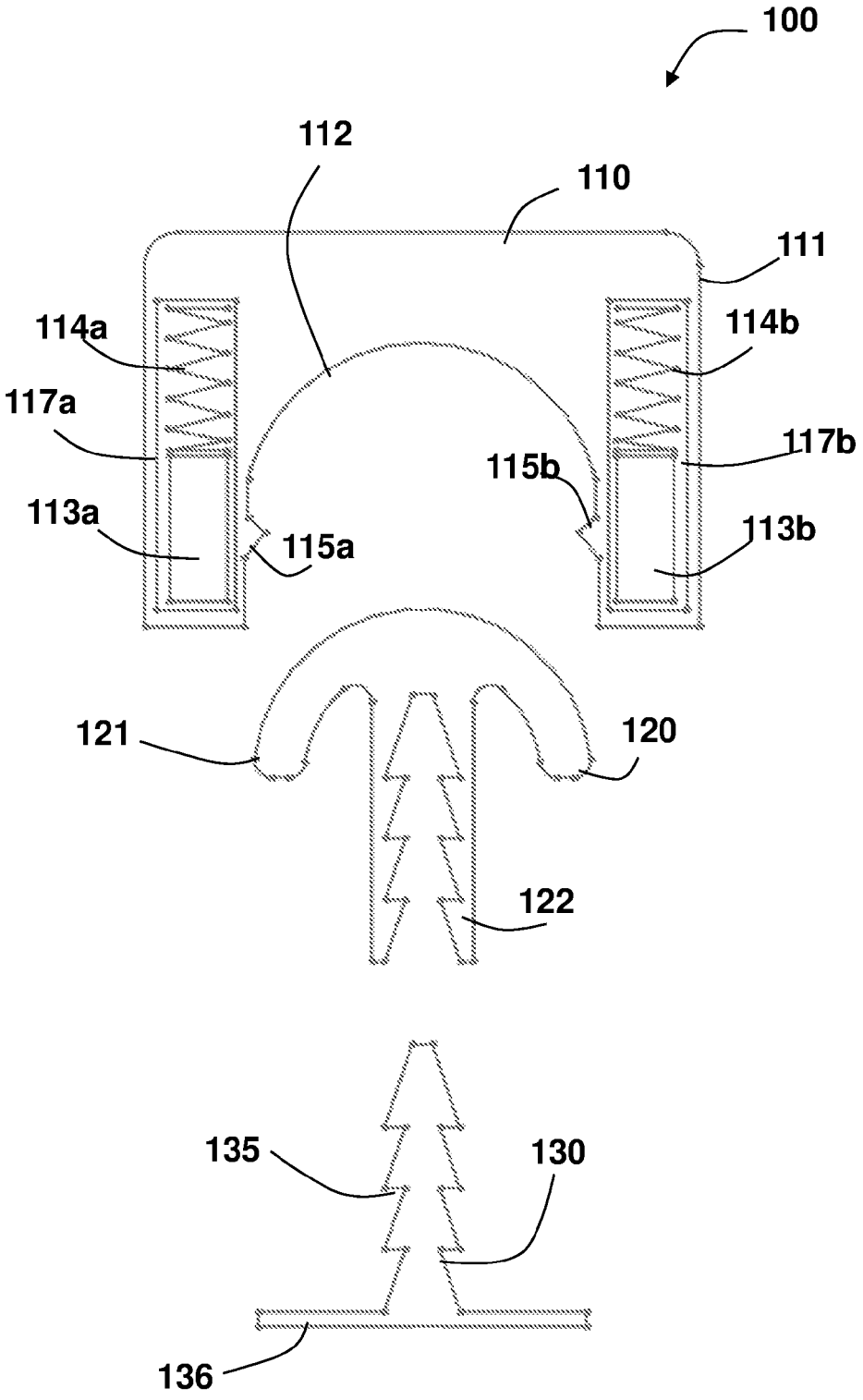
FIGS. 1A-1C show a snap fastener, according to some embodiments of the present invention.

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides a fastener for fastening a first element such as a pouch, a belt and the like to another second element such as a garment, a box and the like in a secured manner such that will require a separate tool such as a powerful magnet or a lock key to reopen the fastening of the fastener. The fasteners of the present invention are especially yet not exclusively designed for securing a device with a sensor such as a tracking device embedded or placed in a garment or casing, to a garment worn by a person for keeping track of that person. This may be useful for children or persons with disablements such autistic people or people with Alzheimer that can get lost. The fastener cannot be easily reopen by the tracked person and therefore the tracking device is likely to be kept worn by that person. In other implementations the fastener can be used for theft prevention being attached to a tracking device such as RFID (radio frequency ID) device or a casing comprising thereof fastened to a product in a shop for instance.

According to some embodiments of the invention, the fastener combines two fastening mechanisms which may be based on the same fastening principle or on two different fastening principles. According to some embodiments, the fastener has three distinguished fastenable parts: a first part, a second part and a third part fastenable to one another and thereby establishing the two fastening mechanisms by connecting to one another in the following manner the second part is fastenable to the third part such as to fasten to a first element such as a garment or any other element by fastening to one another via a first fastening mechanism; and the first part attachable to a second element such as a device, a casing or a pouch, wherein the first part is configured to fasten to the second middle part via a second fastening mechanism for ultimately attaching the first element to the second element.

According to some embodiments, the first fastening mechanism requires the use of an external tool such as a powerful magnetic element or a key in order to open the fastening between the first and second parts. This requires a special mechanism or design of the first part, second part or both.

This means that the third and second parts fasten to one another and thereby hold a first element and the first part fastens to the second part and is attached to the second element (not necessarily through the fastening to the second part). The middle second part is configured to fasten to the first part at one end or one side thereof and to the third part at another side or end thereof.

For example, the third part may include a protrusion such as a pin connectable to the second part. The second part may have an elongated hole niche configured for tightly receiving the protrusion of the third part therein and may include a snap mechanism for holding the pin inside the hole in a secure manner. The pin may be inserted through a portion of the first element, for instance to attach a garment type element between the third and second parts. The second part having the hole niche that receives the pin therein is also configured as an elongated protrusion configured to fasten into another niche at the first part of the fastener through a magnetic or non-magnetic snap fastening mechanism to attach the second part (attached to the first part) to the third part, wherein that first part connects to or is embedded in a second element such as a pouch or a casing holding therein a sensor unit and/or an RFID (radio frequency ID) device for tracking the first element.

Figure 1B:
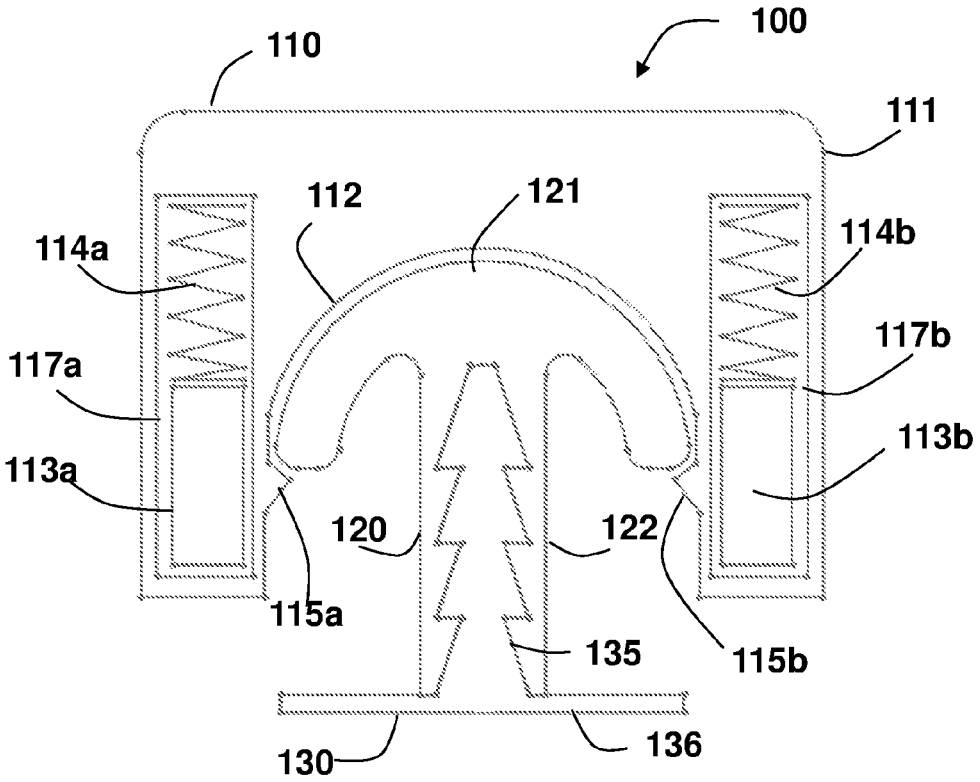
Figure 1C:
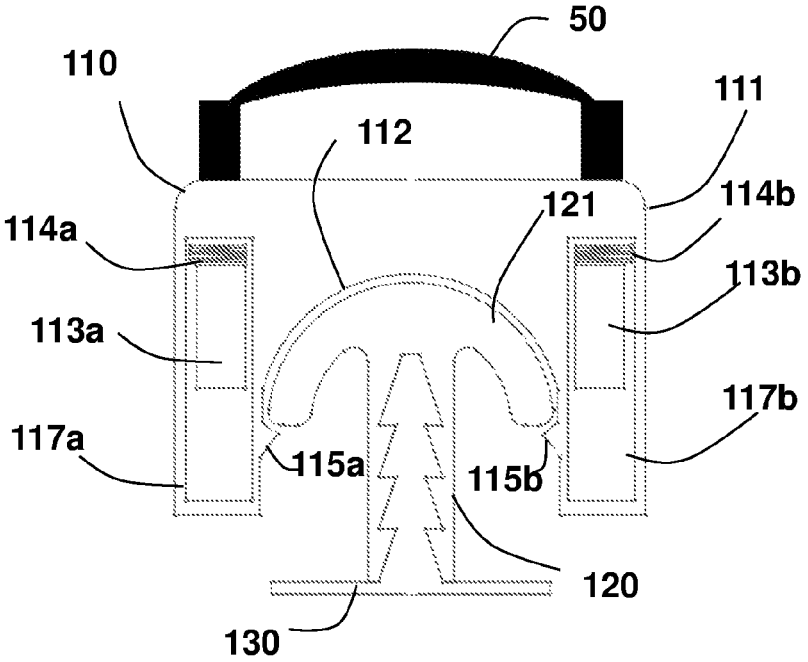

Reference is now made to FIGS. 1A-1C, showing fastened and unfastened positions of a fastener 100 having three fastenable parts: a first member 110; a second member 120; and a third member 130. The first member 110 includes a casing element, which is a solid frame 111 having a recess 112 shaped in one of its sides having a semi spherical shape or any other shape. The recess 112 may have one or more projections such as projections 115*a* and 115*b* protruding inwardly from the sides of the recess 112. The fame 111 includes one or more grooves such as grooves 117*a* and 117*b* for holding metallic pieces 113*a* and 113*b* and springs 114*a* and 114*b* therein.

According to some embodiments, as shown in FIGS. 1A-1C, the third member 130 has a protruding part 135 and a flattened part 136 connected to one another, wherein the protruding part 135 may be externally serrated as shown in FIG. 1A for permanent and irremovable fastening or have an external screw thread for instance for removable fastening of the second and third members 120 and 130. The second member 120 has a semi-knob shaped head 121 having a curvature that fits into the recess 112 of the first member 110; and an elongated portion 122 connected to the head 121 having a recess therein that may be internally serrated or internally screw threaded to allow securing the protruding part 135 of the third member 130, which may respectively be serrated or screw threaded into the recess of the second member 120.

The third and second members 130 and 120 are designed to allow fastening to the second element such as a wearable garment by inserting the protruding part 135 of the third member 130 through a perforation in the garment such that its flattened part 136 faces the inner part of the garment engaging or being closest to the skin of the person wearing the garment and securing the second member 120 thereto. When the second member 120 is secured to the third member 130, the second member 120 can be used for fastening the first element such as a garment to the second element (e.g. the pouch) by inserting the head 121 of the second member 120 into the recess 112 of the first member 110.

As illustrated in FIGS. 1A-1B, once the head 121 of the second member 120 is inserted into the recess 112 of the first member 110, it is snapped by the projections 115*a* and 115*b*. The metallic pieces 113*a* and 113*b* are made from a firm metallic material and inwardly support the walls of the frame 111 to support the projections 115*a* and 115*b* that hold the head 121 inside the recess 112. In the open and closed positions (see FIGS. 1A-1B) the springs 114*a* and 114*b* are in a relaxed position and therefore apply no force over the metallic pieces 113*a* and 113*b*.

However, to allow removing the second member 120 from the first member 110, as illustrated in FIG. 1C, a magnet 50 should be used for pulling the metallic pieces 113*a* and 113*b* upwards towards the magnet 50 such that they will compress the springs 114*a* and 114*b* and allow slight dilation of the frame 112 edges that hold the metallic pieces 113*a* and 113*b* therein to remove the support from the projections 115*a* and 115*b* and allow easy removal of the head 121 from the recess 112. The walls of the frame 111 in this state can move the projections 115*a* and 115*b* away from one another for removing the second member 120. All other components of the fastener 100 other than the metallic pieces 113*a* and 113*b* and optionally the springs 114*a* and 114*b* are made from materials that are not ferromagnetic and cannot attract to the external magnet and therefore cannot be moved thereby. For example, all other components other than the springs and metallic pieces are made from plastic, while the springs and metallic pieces are made from metals such as iron based alloys aluminum based alloy or any other known in the art metal.

Once the magnetic force is applied, as illustrated in FIG. 1C, the lower borders of the metallic pieces 113*a* and 113*b* are pulled such that they are located above the projections 115*a* and 115*b* to prevent the metallic pieces 113*a* and 113*b* from enforcing these parts of the frame 111 walls. In this configuration, these walls can slightly bend away from one another to allow easy removal of the head 121 of the second member 120 from the recess 112 of the first member 110.

The moving of the metallic pieces 113*a* and 113*b* towards the distal edge of the grooves 117*a* and 117*b* by using the external magnet, allows weakening the grip of the projections 115*a* and 115*b* to the head 121 of the second member 120 since these projections 115*a* and 115*b* are not connected to the metallic pieces 113*a* and 113*b* and are not made of a material that attracts to the magnet. This means that once the head 121 of the second member 120 is fit into the recess 112 of the first member 110, the projections 115*a* and 115*b* apply pressure over the head 121 for holding it while the metallic pieces 113*a* and 113*b* apply an additional pressure by firming the structure supporting the projections 115*a* and 115*b*. Once the external magnet is applied pulling the metallic pieces 113*a* and 113*b* away from the projections 115*a* and 115*b*, the grip of the projections 115*a* and 115*b* is dramatically loosened as the framing walls thereof are hollow and made from much more flexible material than that of the metallic pieces 113*a* and 113*b* allowing slightly pushing these walls sideways to pull out the second member 120 from the recess 112, since without the support of the metallic pieces 113*a* and 113*b* the frame in this area is much more flexible.

The metallic pieces may be of any shape such as cylindrical, cuboid, conical, spherical, semi-spherical, or any other elongated or non-elongated shape.

Figure 2:
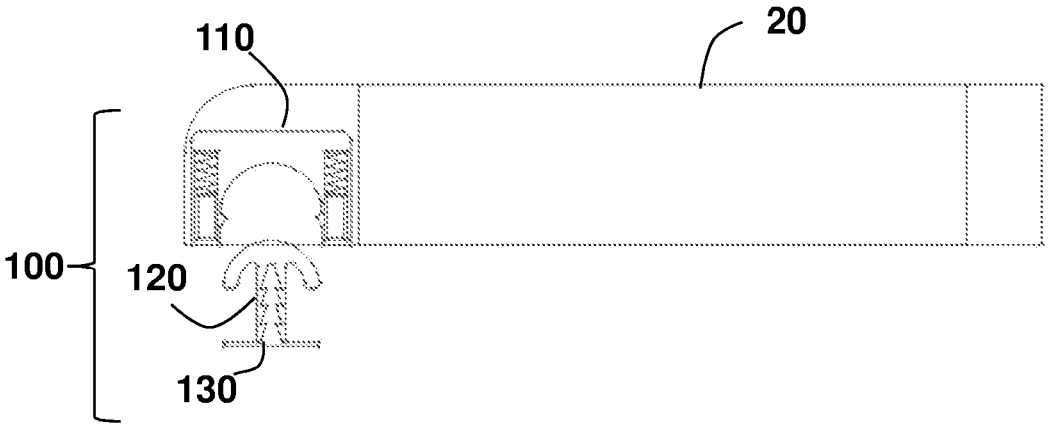
FIG. 2 shows the fastener of FIGS. 1A-1C installed in a pouch.

FIG. 2 shows how the fastener 100 is used for fastening a pouch 20 having the first member 110 of the fastener 100 installed therein to a garment by having the second member 120 thereof removably fastened to the first member 110.

Figure 3:
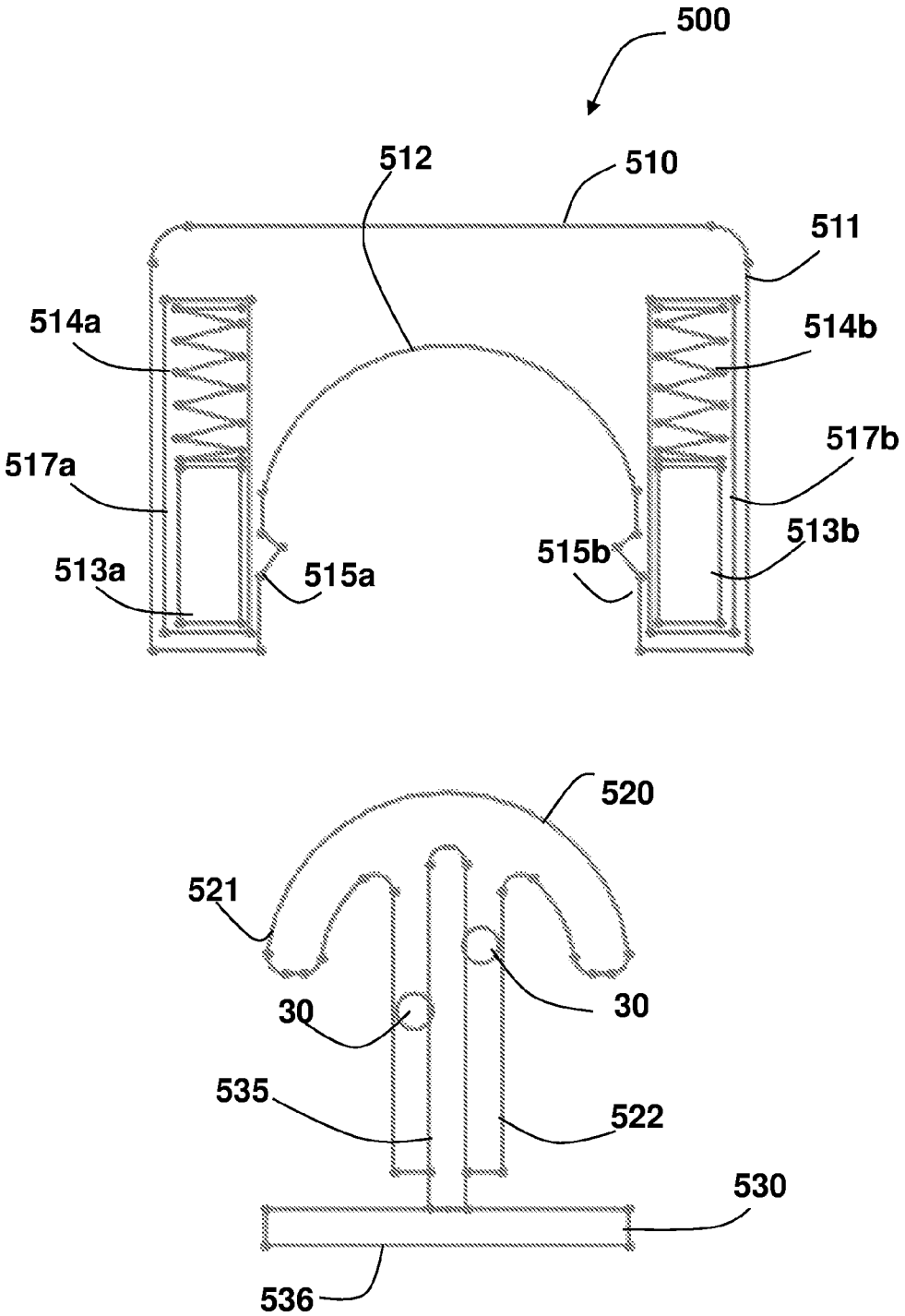
FIG. 3 shows a snap buckle fastener, according to other embodiments of the invention.
Figure 4A:
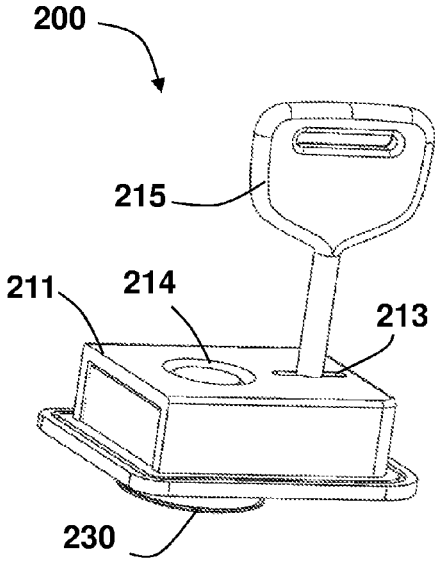
FIGS. 4A-4C show a fastener with a lock mechanism having three parts, according to another embodiment of the invention.
Figure 4B:
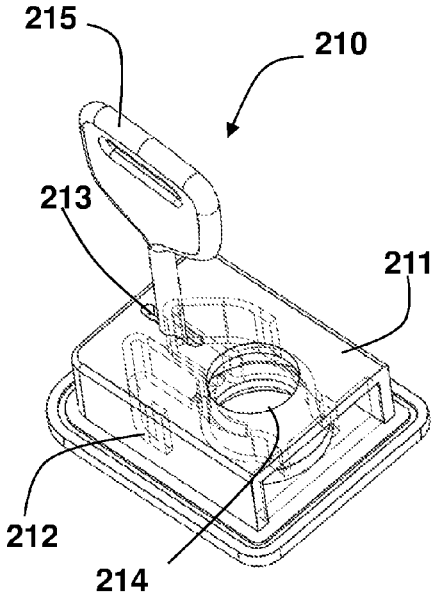
Figure 4C:
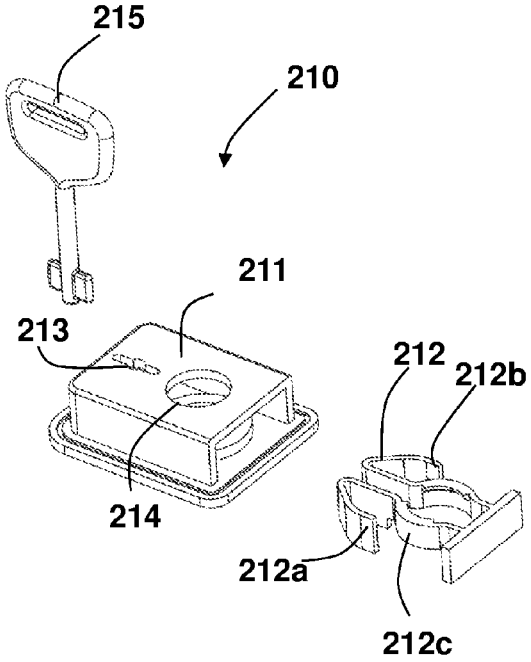
Figure 4D:
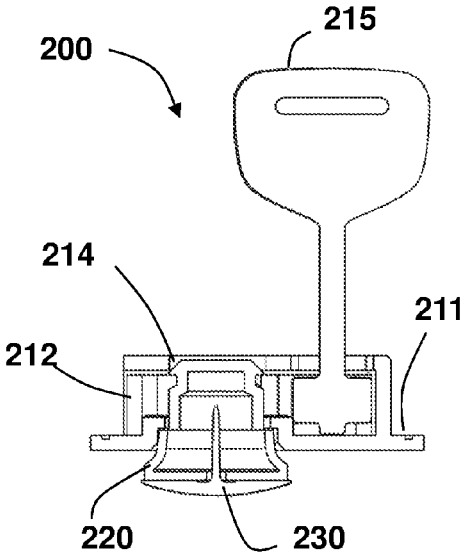
FIG. 4D shows a side cross sectional view of the fastener.

FIG. 3 shows another type of a three components snap fastener 500, according to other embodiments of the invention. This fastener 500 has a first member 510, a second member 520 and a third member 530 fastenable to one another. The first member 510 is similar in configuration to the first member 110 as shown and described in relation to FIGS. 1A-1C. The first member 510 includes a framing element 511 having a recess 512 shaped in one of its sides having a semi spherical shape or any other shape. The recess 512 has projections 515*a* and 515*b* integrally attached thereto. The fame 511 includes one or more grooves such as grooves 517*a* and 517*b* for holding metallic pieces 513*a* and 513*b* and springs 514*a* and 514*b*. In this case, similarly to the fastener 100 described above, to remove the second member 520 from the first member 510 the magnet should be placed near the upper distal edge of the first member 510, where the term "distal" refers to the distance from the second member 520. This will allow pulling the metallic pieces 513*a* and 513*b* upwards towards the distal edge of the grooves 517*a* and 517*b* respectively thereby compressing the springs 514*a* and 514*b* allowing pulling put the second member 520 from the recess 512 of the first member 510 overcoming the relatively weakened snap grip.

The third member 530 has a protruding pin-like part 535 and a flattened part 536 connected to one another. The second member 520 has a knob like head 521 having a curvature that fits into the recess 512 of the first member 510; and an elongated portion 522 having an elongated recess therein, connected to the head 521 having a recess hole therein that fits in dimensions and length to the dimension and length of the protruding part 535 of the third member 530. The second member 520 includes a multiplicity of metal spherical elements 30 located inside the elongated portion 522. The spherical elements 30 act as snap holders and hold the pin like protrusion 535 of the third member 530 inside the hole of the elongated portion 522. The protruding pin 535 can be pulled out by using an external magnet attracting the metal spherical elements 30 away from the pin like protrusion 535 for overcoming the grip of the spherical elements 30 thereto.

The mechanism for using spherical snap elements is known in the art and will be referred to hereinafter as "the spherical elements snap mechanism"

Reference is now made to FIGS. 4A-4D illustrating a fastener 200 having a lock mechanism, according to other embodiments of the invention. According to these embodiments, the fastener 200 has three parts: a first part 210 which has a casing 211 holding therein a clip member 212; a second part 220 and a third part 230 fastenable to one another as follows: the third part 230 fastens to the second part 220 through the spherical elements snap mechanism or any other fastening mechanism known in the art. The casing 211 of the first member 210 includes an opening recess 214 for receiving and holding at least part of the second member 220 therein and a key hole 213 for receiving a key 215 therein. The clip member 212 is held inside the casing 211 and has two pincers 212*a* and 212*b* connected to a grip 212*c* located under said opening recess 214 and configured for gripping to the second member 220 part inserted through the opening recess 214. The pincers 212*a* and 212*b* and grip 212*c* have a certain degree of flexibility that allows it to slightly open when the key 215 is rotated to an unlock position and retract back to a closed position when the key 215 is returned rotatably to a locked position. As shown in the transparent view of FIG. 4B, once the key 215 is in the locked position its two protrusions do not dilate the gap between the pincers 212*a* and 212*b*. when the key 215 is rotated at about 90 degrees from the locked position thereof inside the key hole 213, its protrusions dilate the gap between the pincers 212*a* and 212*b* of the clip member 212 and therefor the grip 212*c* is also dilated allowing removal or insertion of the protruding portion of the second member 220 into the opening recess 214. Once inside and the key 215 is turned back to the locked position, the pincers 212*a* and 212*b* retract back and the grip 201*c* also retracts and tightens its grip over the second member 220 forming thereby the fastening of the first member 210 to the second member 220.

Reference is now made to FIGS. 5A-5D illustrating a fastener 300 having a lock mechanism, according to yet other embodiments of the invention. According to these embodiments, the fastener 300 has three parts: a first part 310 which has a casing 311 holding therein a clip member 312; a second part 320 and a third part 330 fastenable to one another as follows: the third part 330 fastens to the second part 320 through the spherical elements snap mechanism or any other fastening mechanism known in the art. The casing 311 of the first member 310 includes an opening recess 314 for receiving and holding at least part of the second member 320 therein and two key holes 313*a* and 313*b* located in front of said pincers 312*a* and for receiving edges 315*a* and 315*b* of a key 315 therein. The clip member 312 is held inside the casing 311 and has two pincers 312*a* and 312*b* connected to a grip 312*c* configured for gripping to the second member 320 part inserted through the opening recess 314. The pincers 312*a* and 312*b* and grip 312*c* have a certain degree of flexibility that allows it to slightly open when the key 315 is inserted through key holes 313*a* and 313*b* to unlock the clip member 312 and retract back to a closed position when the key 315 is removed from key holes 313*a* and 313*b*. In these embodiments, the key 315 is configure to be inserted from the side of the casing 311 and therefore the key 315 should be held at the same planar direction as the casing 311 and the clip member 312 unlike the direction of the key 215 insertion described in FIGS. 4A-4D, which is perpendicular to the plane of the clip member 212 and casing 211. The configuration described in FIGS. 5A-5D allows easier access to the key holes in some cases.

Figure 5A:
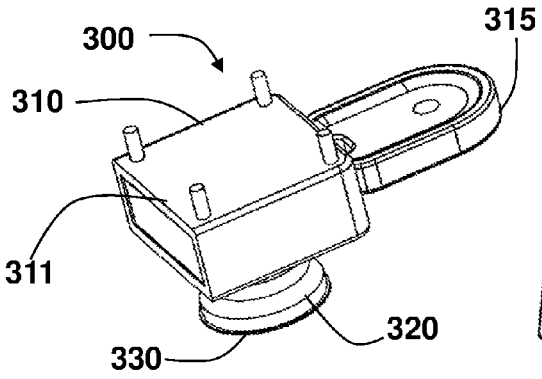
FIGS. 5A-5C show a fastener with a lock mechanism having three parts, according to yet another embodiment of the invention.
Figure 5B:
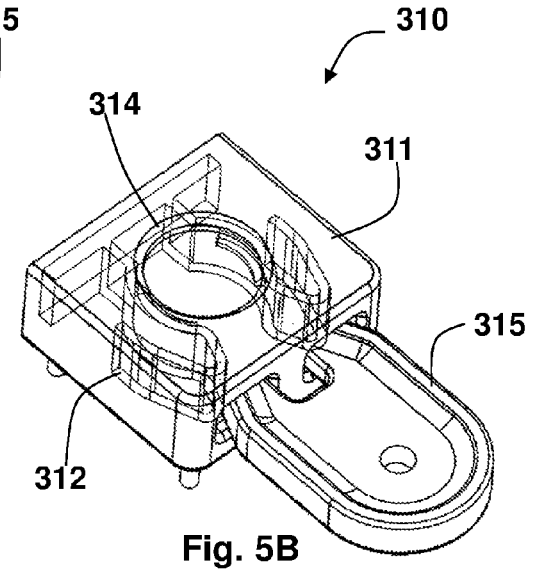
Figure 5C:
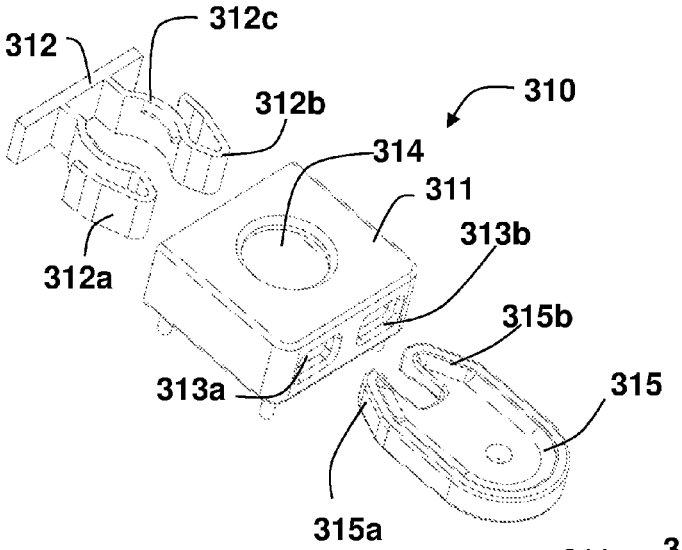
Figure 5D:
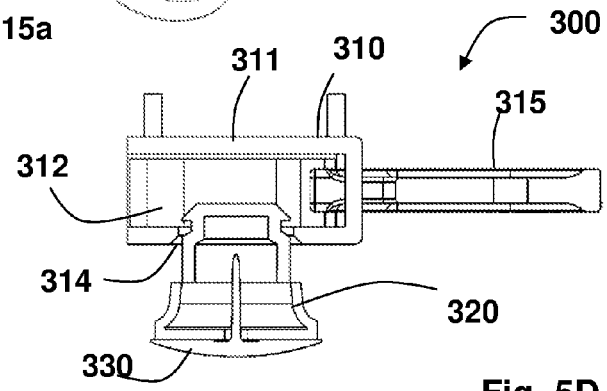
FIG. 5D shows a side cross sectional view of the fastener.

As shown in the transparent view of FIG. 5B, once the key 315 is inside the key holes 313*a* and 313*b* its two protrusions dilate the gap between the pincers 312*a* and 312*b* allowing thereby to insert the second member 320 into the opening recess 314 and once the key 315 is removed from the key holes 313*a* and 313*b* the clip member pincers 312*a* and 312*b* retract to their non-dilated position and therefor the grip 312*c* also retract back and tightly grips the second member 220 therein.

Any type of fastening can be used for the second and first members using any design, fastening mechanism and shape, wherein the fastening between the first member 210/310 and second member 220/320 is carried out by adapting the shape and size of the opening recess 214/314 thereof to the shape and size of at least part of the second member 220/320.

According to some embodiments, the first element to or in which the first part of the fastener, in any embodiment thereof, is attached, embedded or placed comprises a tracking unit, configured to enable tracking that second element to which the fastener fastens or the person which carries it. The tracking unit may comprise a transmission unit configured for transmitting signals for locating the second element to which the first element ultimately fastens through the fastener, such as, for example, RFID device, GPS device or any other transmission device that allows wireless long and/or short distance locating.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations.

The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

The invention claimed is:

1. A fastener for fastening a first element to a second element, said fastener comprising:

a first part;

a second part fastenable to said first part via a first fastening mechanism; and a third part fastenable to said second part via a second fastening mechanism, said third part comprises at least one protruding member for inserting thereof to the second element for fastening said second element between said second and third parts, wherein said first part is attachable, embedded or placed in said first element thereby ultimately enabling fastening said first element to said second element, wherein said first fastening mechanism is configured such that to open the fastening of said first part to said second part an external tool should be applied, wherein said first fastening mechanism is based on snap or magnetic fastening and said second fastening mechanism is based on snap fastening, wherein said first part comprises:

a casing configured to form at least one inner groove, a recess and at least one projection for snap fastening said at least one projection located inwardly over said recess, said recess configured to hold therein at least one portion of said second part for fastening thereto;

at least one metallic piece located inside said at least one inner groove; and at least one spring engaging said at least one metallic piece such that on applying an external magnetic force, using an external magnet, the at least one metallic piece moves in said groove such that the at least one metallic piece compresses said at least one spring thereby slightly dilating said recess to allow removal of said second part therefrom, and wherein said second part comprises a knob shaped head portion connected to an elongated portion having a recess therein; and said third part comprises a flattened part connected to a protruding part, said protruding part is configured to be inserted into said recess of said elongated part of said second part for fastening thereto and said knob shaped head portion of said second part is configured for fitting into the recess of said first part for fastening thereto.

2. The fastener according to claim 1, wherein said protruding part of said third part is externally serrated and said recess of said second part is inwardly serrated to allow irremovable fastening of the third part to the second part.

3. The fastener according to claim 1, wherein said protruding part of said third part is externally screw threaded and said recess of said second part is inwardly screw threaded to allow removable fastening of the third part to the second part.

4. A fastener for fastening a first element to a second element, said fastener comprising:

a first part;

a second part fastenable to said first part via a first fastening mechanism; and a third part fastenable to said second part via a second fastening mechanism, said third part comprises at least one protruding member for inserting thereof to the second element for fastening said second element between said second and third parts, wherein said first part is attachable, embedded or placed in said first element thereby ultimately enabling fastening said first element to said second element, wherein said first fastening mechanism is configured such that to open the fastening of said first part to said second part an external tool should be applied, wherein said first fastening mechanism is based on snap or magnetic fastening and said second fastening mechanism is based on snap fastening, wherein said first part comprises:

a casing configured to form at least one inner groove, a recess and at least one projection for snap fastening said at least one projection located inwardly over said recess, said recess is configured to hold therein at least one portion of said second part for fastening thereto;

at least one metallic piece located inside said at least one inner groove; and at least one spring engaging said at least one metallic piece such that once applying an external magnetic force, using an external magnet the at least one metallic piece moves in said groove such that the at least one metallic piece compresses said at least one spring engaging thereof thereby slightly dilating said recess to allow removal of said second part therefrom; and wherein said third part comprises an elongated pin like part connected to a flattened part, and said second part comprises:

a head configured to fit into the recess of said first part;

an elongated portion having a recess therein configured for receiving said pin like part of said third part; and at least one spherical element configured for snap fastening said pin like part of said third part in said recess of said second part.

5. A fastener for fastening a first element to a second element, said fastener comprising:

a first part;

a second part fastenable to said first part via a first fastening mechanism; and a third part fastenable to said second part via a second fastening mechanism, said third part comprises at least one protruding member for inserting thereof to the second element for fastening said second element between said second and third parts, wherein said first part is attachable, embedded or placed in said first element thereby ultimately enabling fastening said first element to said second element, wherein said first fastening mechanism is configured such that to open the fastening of said first part to said second part an external tool should be applied, and wherein said first part comprises:

a casing having an opening recess for fitting therethrough a portion of said second part and at least one key hole; and a clip member located inside said casing and configured for clip fastening said portion of said second member once inserted through said opening recess, said clip member having two pincers connected to a grip, wherein once a designated key configured to fit into said at least one key hole is inserted through said at least one key hole and rotated therein, the designated key dilates the gap between said pincers thereby allowing removal of said second part portion from said opening recess for unfastening thereof.

6. The fastener according to claim 5, wherein said at least one key hole comprises a single key hole.

7. The fastener according to claim 6, wherein said designated key includes protrusions and said single key hole is located such that the protrusions of said key will be located between the princes of the clip member for dilating thereof upon rotation of said key.

8. The fastener according to claim 5, wherein said at least one key hole comprises two key holes located in front of said pincers and said designated key includes two edges configured for being inserted through said key holes for dilating the gap between said pincers.

* * * * *